US005791108A

United States Patent [19]

Conti

[11] Patent Number: 5,791,108

[45] Date of Patent: Aug. 11, 1998

[54] GLASS BRICK PARTITION MEMBERS

[76] Inventor: Jean-Pierre Conti, 47 chemin de l'Etang, 1219 Chatelaine-Genève, Switzerland

[21] Appl. No.: 734,306

[22] Filed: Oct. 21, 1996

Related U.S. Application Data

[63] Continuation of Ser. No. 284,636, filed as PCT/EP93/03639 Dec. 16, 1993 published as WO94/15040 Jul. 7, 1994, abandoned.

[30] Foreign Application Priority Data

Dec. 18, 1992 [FR] France ..... 9215563

[51] Int. Cl.[6] ..... E04C 1/42

[52] U.S. Cl. ..... 52/308; 52/307

[58] Field of Search ..... 52/306–308; 211/186, 211/189; 108/101, 152, 153, 180, 185

[56] References Cited

U.S. PATENT DOCUMENTS

| | | | |
|---|---|---|---|
| 2,007,716 | 7/1935 | Green | 52/668 |
| 2,008,907 | 7/1935 | Green | 52/668 |
| 2,198,450 | 4/1940 | Chertkof | 52/200 |
| 2,199,244 | 4/1940 | Mulford | 52/307 |
| 2,239,537 | 4/1941 | Owen . | |
| 2,835,623 | 5/1958 | Vincent et al. | 52/308 X |
| 4,924,649 | 5/1990 | Taylor | 52/626.1 |
| 5,003,744 | 4/1991 | Taylor | 52/668 X |
| 5,031,372 | 7/1991 | McCluer . | |
| 5,033,245 | 7/1991 | Kline | 52/306 |
| 5,042,210 | 8/1991 | Taylor . | |
| 5,157,892 | 10/1992 | Ryther | 52/668 X |

FOREIGN PATENT DOCUMENTS

| | | |
|---|---|---|
| 2524044 | 9/1983 | France . |
| 2334685 | 1/1975 | Germany . |
| 33 09 463 A1 | 3/1983 | Germany . |

*Primary Examiner*—Carl D. Friedman
*Assistant Examiner*—Beth A. Aubrey
*Attorney, Agent, or Firm*—Ratner & Prestia

[57] ABSTRACT

Partition members including frame members forming an open-cell frame structure for housing glass bricks. Beads are shaped to fit the edges of the frame members around the cell openings, and overlap the edges of the glass bricks to hold them in their respective cells.

9 Claims, 4 Drawing Sheets

GLASS BRICK PARTITION MEMBERS

This application is a continuation of U.S. application Ser. No. 08/284,636, filed as PCT/EP93/03639 Dec. 16, 1993 published as WO94/15040 Jul. 7, 1994, now abandoned.

The present invention concerns the construction of buildings and in particular internal or external walls incorporating glass bricks.

Glass bricks have long been used in the construction of buildings to constitute transparent or translucent wall sections. The traditional method of using them is to stack the glass bricks with mortar joints between them. This requires skilled labour, because it is difficult to make mortar joints that look regular and are of even thickness. The bricks must also be assembled together on site, with no possibility of prefabrication.

To enable prefabrication, as disclosed in document DE-A-2 334 685, it would be feasible to construct in the workshop a frame with cells open on two opposite sides and each shaped to receive a glass brick with small clearance. The bricks can then be inserted either in the workshop or on site. A plurality of adjacent frames can be assembled together by means of pins or rails. The problem is to retain the bricks in the cells. This prior art document does not address this problem or any way of preventing the bricks from being removed one by one from the frame, or from falling out of in the event of accidental impact against the wall.

Document U.S. Pat. No. 2,239,537 describes a different glass brick wall structure in which the bricks are inserted into a structure including horizontal metal strips with elastic curved flanges and vertical reinforcing strips of various materials. The bricks are held directly by the elastic curved flanges, which are thereafter held apart with mastic. Mastic is also forced between the vertical surfaces of adjacent bricks. A structure of this kind is not demountable and reusable without replacing the material, in particular the mastic. The fact that it is difficult to make mastic joints of even thickness means that this solution requires long and complex operations on site and does not provide an easy way of obtaining a satisfactory and durable aesthetic appearance.

One problem arises from the fact that a wall must have an acceptable aesthetic character. In particular, the wall parts between adjacent bricks must have a pleasant exterior aspect and this makes it necessary to consider the use of high quality materials such as wood, metal and plastics material. The production cost is then relatively high if the high quality material constitutes all of the frame comprising the plurality of cells.

The problem to which the present invention is addressed is that of designing a new glass brick wall member structure in which the frame members procure at minimum cost both an agreeable aesthetic appearance and effective retention of the glass bricks within the cells.

Another object of the invention is to provide a glass brick wall member structure of this kind which is easily assembled by an unskilled person, preferably without the use of special tools.

Another advantage of the invention is that a glass brick wall member structure of this kind is easier to transport and store in the form of packaged components of smaller volume, and that it can be totally or partially demounted and reassembled without requiring additional material such as mastic. It is therefore easy to replace all or some of the glass bricks, either because they are broken or deteriorated in some way, or to change their appearance.

The basic idea behind the invention is to hold the glass bricks inside the cells by cover strips attached to the edges of the frame members. The cover strips are the only components visible from the outside. As a result the internal structure of the frame can be made from a lower quality material, only the cover strips having to be made from a higher quality material of agreeable appearance. These cover strips must be easy to fit and must hold the glass bricks very effectively.

Accordingly, the glass brick wall members of the present invention comprise frame members forming a structure with cells open on two opposite sides and each shaped to receive a glass brick with a small clearance. Cover strips are shaped to be fixed to the edges of the frame members around the openings of said cells and to overlap the edges of the glass bricks to hold them in their respective cells.

In one embodiment of the invention the frame members comprise two series of notched parallel plates assembled perpendicularly to each other and overlapping halfway.

Other objects, features and advantages of the present invention will emerge from the following description of specific embodiments of the invention with reference to the appended figures, in which.

Figure 1:
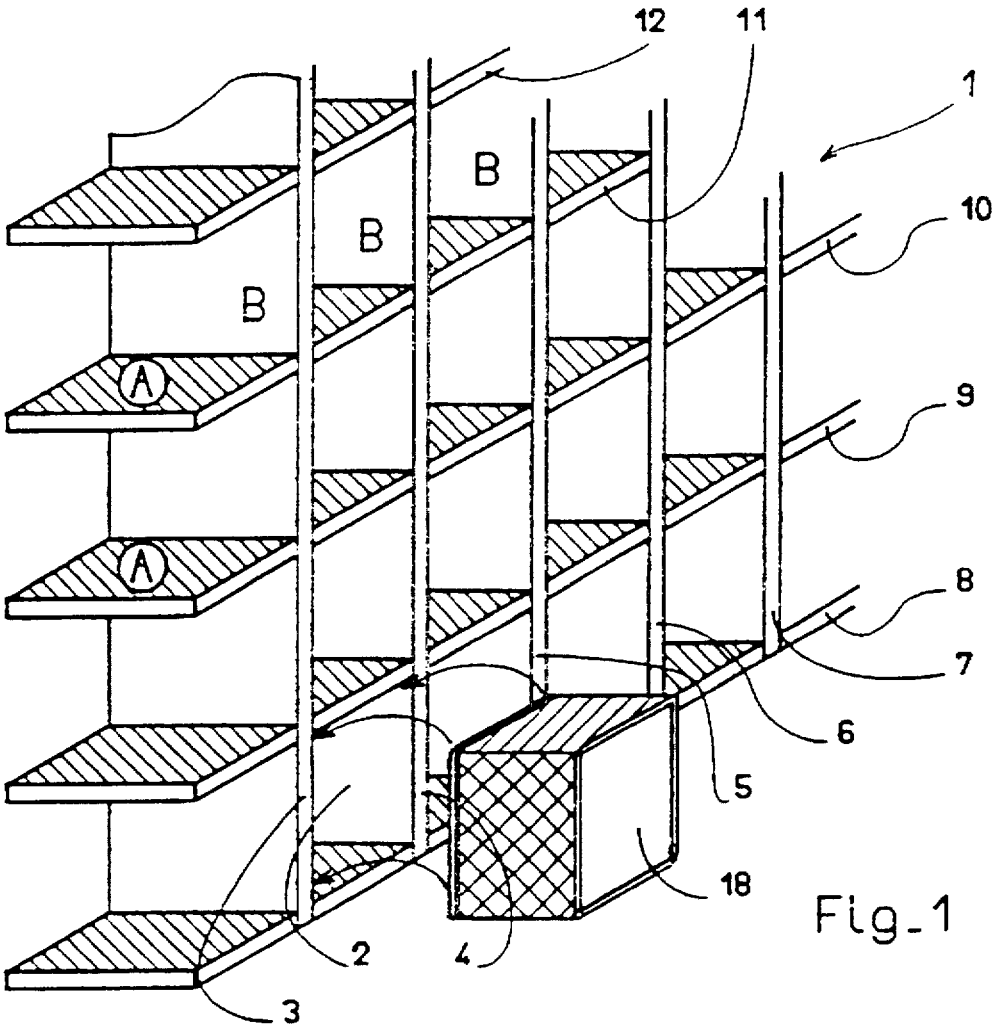
FIG. 1 is a diagrammatic perspective view of a frame structure in accordance with the invention adapted to receive glass bricks.

In the embodiment shown in FIG. 1 the frame members of the invention form a frame structure 1 with rectangular or square cells, such as the cell 2, the cells being adjacent and aligned and separated by plane walls such as the wall 3.

Figure 2:
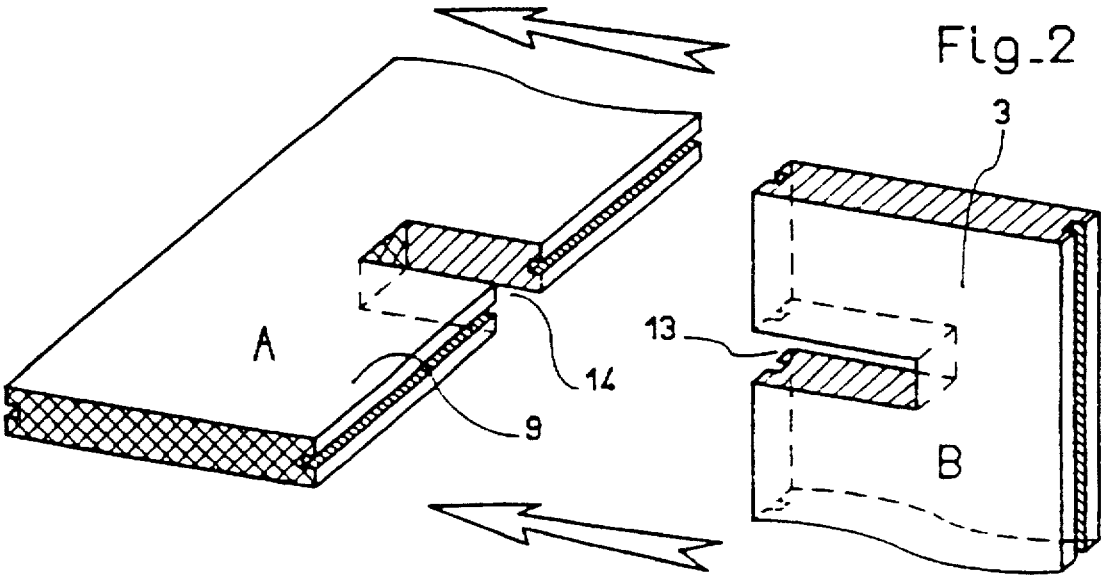
FIG. 2 shows the halfway overlapping assembly of two perpendicular plates forming the frame.

The frame structure 1 is formed from two series of parallel plates, namely the plates 3, 4, 5, 6 and 7 in the figure forming a first series B of plates and the plates 8, 9, 10, 11 and 12 forming a second series A of plates. The plates of the first series B of plates are assembled to the plates of the second series A of plates by a halfway overlapping type assembly, as shown in FIG. 2. To this end the plate 3 comprises notches such as the notch 13 and the plate 9 comprises notches such as the notch 14, the notches 13 and 14 having a depth equal to half the width of a plate, and nesting together as shown in the figure.

Figure 3:
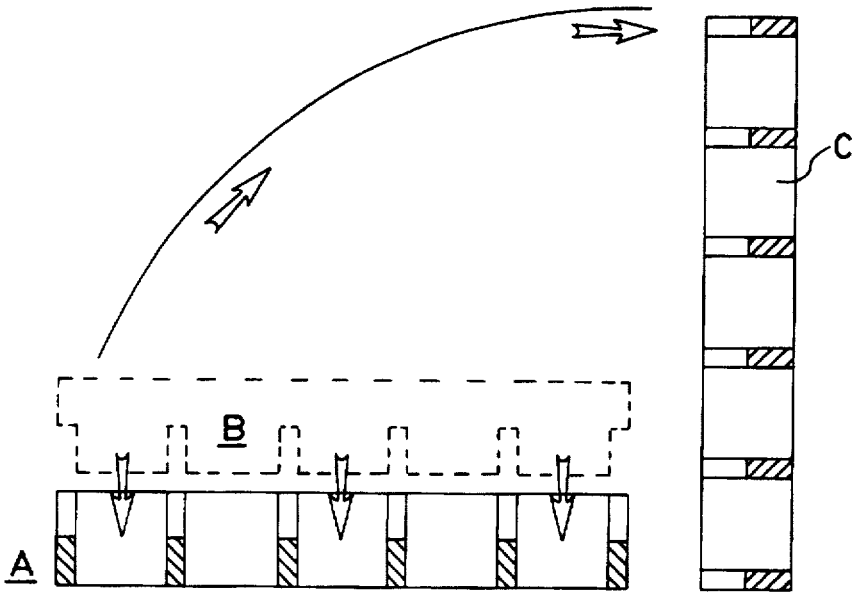
FIG. 3 shows the steps of assembling the frame.

Referring to FIG. 3, the frame plates are assembled together with the plates of the first series B of plates disposed in a row of parallel plates laid on edge on the floor with their notches facing upwards and the plates of the second series A of plates being oriented with their notches facing downwards and nested one after the other into the respective notches of the plates of the first series B of plates. The resulting frame is then lifted into the vertical position C.

Figure 4:
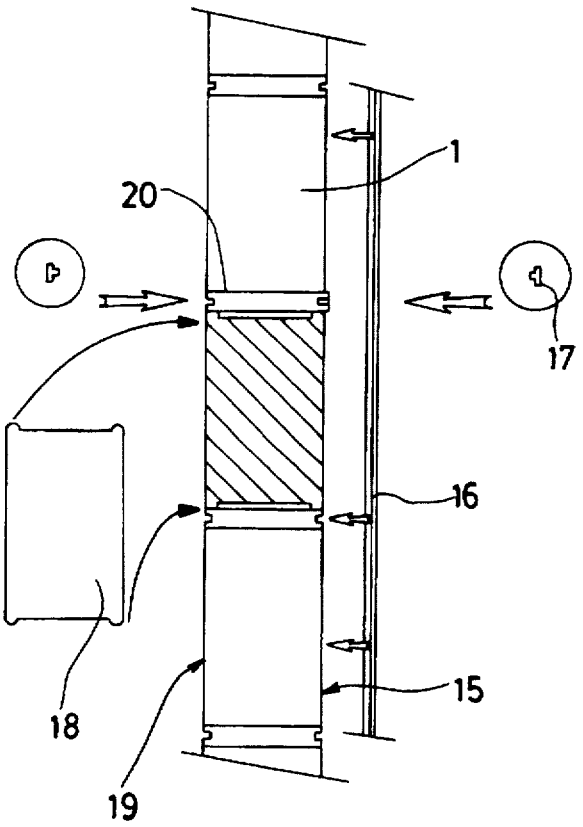
FIG. 4 is a side view in vertical section of a wall of the present invention.

Referring to FIG. 4, the first side 15 of the frame is fitted with cover strips 16 and 17 which cover the edges of the frame members on this first side 15.

The glass bricks such as the brick 18 are then inserted into the cells formed by the frame members. Finally, cover strips similar to the cover strips 16 and 17 on the first side 15 are fitted to the edges of the frame members on the second side 19 of the frame.

Figure 5:
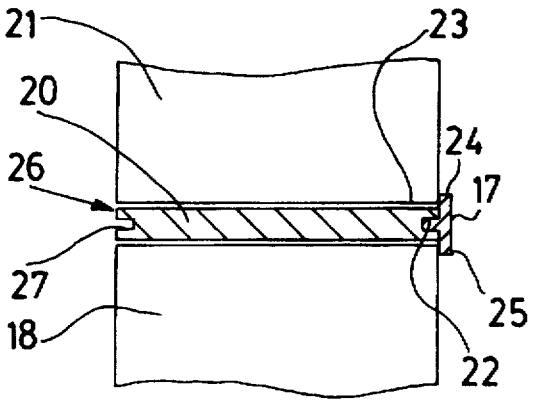
FIGS. 5 through 7 are three side views in partial cross-section showing three embodiments of the cover strips of the invention.

In the embodiment shown in FIG. 5 the frame wall 20 separates two glass bricks 18 and 21. In this embodiment the frame walls such as the wall 20 have a width substantially equal to the depth of the glass bricks, so that their edges are flush with the respective outside surfaces of the glass bricks. The cover strips 17 comprise a longitudinal intermediate rib 22 which is a force fit in a groove 23 in the corresponding edge of the frame member such as the plate 20. The lateral edges 24 and 25 of the cover strips 17 overlap the respective edges of the glass bricks 18 and 21, to retain the glass bricks in their respective cell. The cover strips 17 thus have a T-shape cross-section, as shown in the figure. A similar second cover strip must be fitted to the opposite second edge 26 of the plate 20, in which second edge 26 there is a groove 27 for receiving the respective rib of the cover strip.

Figure 6:
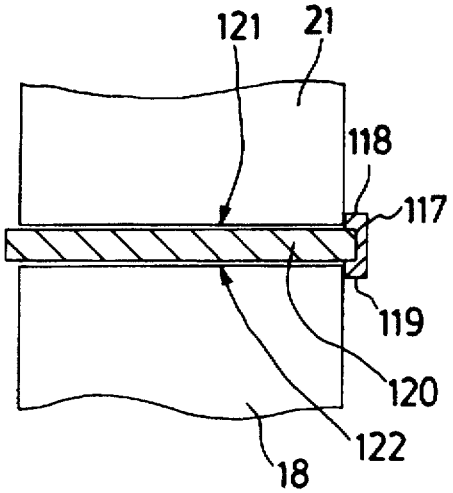

In the FIG. 6 embodiment the plate 120 has a width greater than the depth of the glass bricks 18 or 21. The cover strips 117 have two lateral ribs 118 and 119 which bear on the edges of the respective outside surfaces of the respective glass bricks 21 and 18. In this case the lateral ribs 118 and 119 can be force fitted to the respective lateral surfaces 121 and 122 of the plate 120. Cover strips 117 of this kind can optionally include an intermediate longitudinal rib such as the rib 22 engaging in a respective groove in the plate 120.

Figure 7:
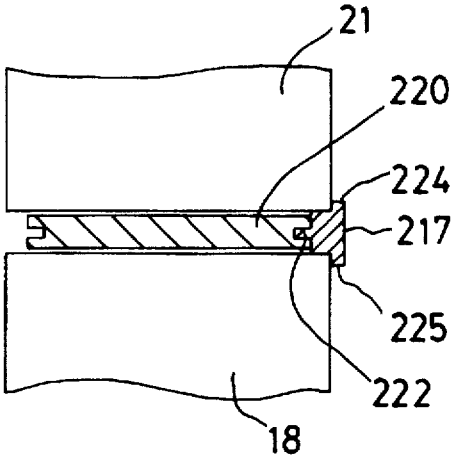

In the FIG. 7 embodiment the plate 220 has a width less than the depth of the glass bricks 18 and 21. The cover strips 217 in this case have an elongate body to compensate for the difference between the width of the plate 220 and the depth of the glass bricks 18 and 21, as shown in the figure, the two lateral flanges 224 and 225 of the cover strips 217 bearing on the edges of the outside surfaces of the glass bricks 18 and 21 to retain them. The cover strips 217 also have a rib 222 force fitted into a respective groove in the edge of the plate 220.

The cover strips can advantageously be designed to be forcibly retained on the respective edges of the frame members. Alternatively, the cover strips can additionally be glued, riveted, nailed or clipped to the respective frame members.

Figure 8:
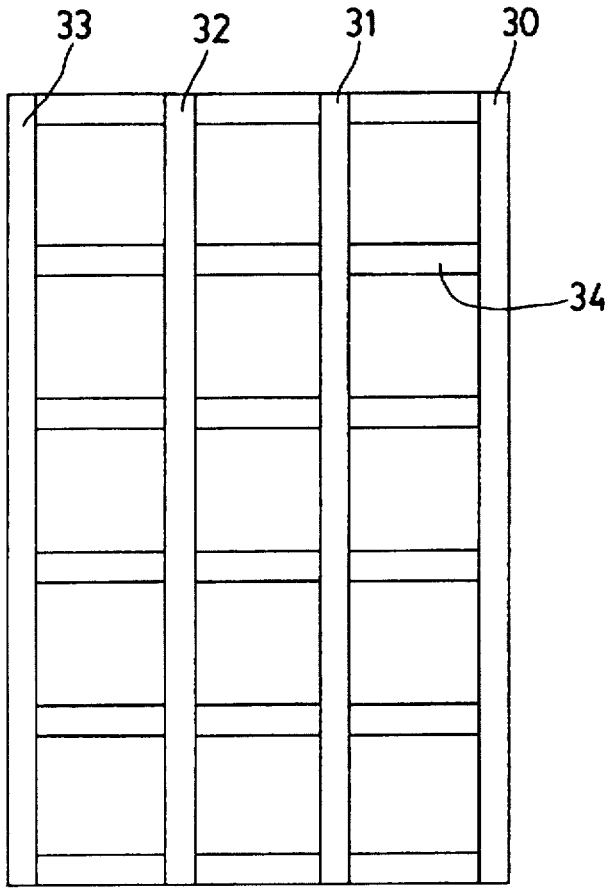
FIG. 8 is a general front view of a panel in one embodiment of the invention.

In the embodiment shown in FIG. 8 in front view a wall of the invention can comprise cover strips of two types: the cover strips of a first type are long strips like the strips 30, 31, 32 and 33 to cover all of the length of the edge of the plates of the first series of plates. The cover strips of the second type are short strips such as the strip 34 to cover the length of the edge of the plates of the second series of plates between two successive long strips such as the strips 30 and 31.

In an assembly in accordance with the present invention only the glass bricks and the cover strips can be seen from the outside. The frame members consisting of the two series of plates can therefore be made from a low cost composite material such as reconstituted wood while the cover strips are advantageously made from a different material with appropriate aesthetic properties. The cover strips can be made from high quality wood, metal or plastics material, for example. The cover strips can be varnished, painted or decorated in various ways, without it being necessary to varnish, paint or decorate the plates forming the internal members of the frame.

The present invention is not limited to the embodiments explicitly described but includes the various variants and generalisations thereof within the scope of the following claims.

I claim:

1. Glass brick wall members comprising glass bricks, frame plates and cover strips, said glass bricks having a plurality of edges and outside surfaces, said frame plates having opposed edges and lateral surfaces, forming a frame structure with cells between said frame plates completely open on two opposite sides of the cells for individually receiving an individual one of said glass bricks on each of said two opposite sides of the cells with a small clearance, wherein said frame plates have a uniform thickness to permit said cells to have a uniform thickness and said cover strips are shaped to be removably fixed to the opposed edges of the frame plates around the openings of the cells and to overlap the edges of the glass bricks to retain said glass bricks in their respective cells.

2. The members according to claim 1 wherein the frame structure comprises adjacent and aligned rectangular or square cells separated by plane walls.

3. The members according to claim 1 wherein the frame plates comprise a first and a second series of parallel plates, said parallel plates having notches assembled to allow plates of the first series to attach perpendicularly to plates of the second series and the two series of plates overlap each other halfway.

4. The members according to claim 3 wherein the cover strips comprise two sets of perpendicular strips, the first set covering all the length of the edge of the plates of a first series of plates and the second set covering the length of the edge of the plates of the second series of plates, the second set positioned between two successive strips of the first set.

5. The members according to claim 1 wherein the edges of the frame plates form a groove and wherein each cover strips comprises a longitudinal intermediate rib adapted to be force fitted into the groove.

6. The members according to claim 1 wherein the cover strips comprise two lateral ribs bearing on the outside surfaces of the glass bricks.

7. The members according to claim 6 wherein the lateral ribs are also force fitted around the lateral surfaces of the frame plate.

8. The members according to claim 1 wherein the cover strips are additionally glued, riveted, nailed or clipped to the frame plates.

9. The members according to claim 1 wherein the frame plates are made from a composite material such as reconstituted wood and the cover strips are made from a different material having appropriate aesthetic properties.

* * * * *

UNITED STATES PATENT AND TRADE MARK OFFICE

CERTIFICATE OF CORRECTION

PATENT NO. : 5,791,108
DATED : Aug. 11, 1998
INVENTOR(S) : Conti

It is certified that error appears in the above-identified patent and that said Letters Patent is hereby corrected as shown below:

On the cover page --

[76] Inventor: Jean-Pierre Conti, 42 route de Satigny, CH-1217 Meyrin, Switzerland Column 4, line 40, claim 5 --

"strips" should read --strip--.

Signed and Sealed this

Fifteenth Day of June, 1999

*Attest:*

Q. TODD DICKINSON

*Attesting Officer*

*Acting Commissioner of Patents and Trademarks*